US006303096B1

(12) United States Patent
Yamamoto et al.

(10) Patent No.: US 6,303,096 B1
(45) Date of Patent: Oct. 16, 2001

(54) PITCH BASED CARBON FIBERS

(75) Inventors: Iwao Yamamoto; Toshihiro Fukagawa; Akihiko Yoshiya, all of Tokyo (JP); Mika Muroi, Kagawa (JP)

(73) Assignee: Mitsubishi Chemical Corporation, Tokyo (JP)

( * ) Notice: Subject to any disclaimer, the term of this patent is extended or adjusted under 35 U.S.C. 154(b) by 0 days.

(21) Appl. No.: 09/271,482

(22) Filed: Mar. 18, 1999

(30) Foreign Application Priority Data

Nov. 10, 1998 (JP) ..... 10-318645

(51) Int. Cl.[7] ..... D01F 9/12
(52) U.S. Cl. ..... 423/447.2; 423/448
(58) Field of Search ..... 423/448, 447.2

(56) References Cited

U.S. PATENT DOCUMENTS

| | | | | |
|---|---|---|---|---|
| 4,822,587 | * | 4/1989 | Hino et al. | 423/447.2 |
| 4,983,457 | * | 1/1991 | Hino et al. | 428/367 |
| 5,213,677 | | 5/1993 | Yamamoto et al. . | |
| 5,266,294 | | 11/1993 | Schulz et al. . | |
| 5,348,719 | | 9/1994 | Yamamoto et al. . | |
| 5,601,794 | | 2/1997 | Yamamoto et al. . | |
| 5,643,546 | | 7/1997 | Yamamoto et al. . | |
| 5,721,308 | | 2/1998 | Yamamoto et al. . | |
| 5,840,265 | | 11/1998 | Yamamoto et al. . | |

FOREIGN PATENT DOCUMENTS

| | | |
|---|---|---|
| 0 481 762 | 4/1992 | (EP) . |
| 9-119024 | 5/1997 | (JP) . |

OTHER PUBLICATIONS

S. Otani, et al., Carbon Fibers, pp. 733–743, "Method for Measuring the Lattice Constant and the Crystallite Size of Artificial Graphite", 1986.
J.D. Buckley, et al., Carbon–Carbon Materials and Composites, pp. 2–3, 1993.
G. Savage, Carbon–Carbon Composites, pp. 20–23, "X–Ray Diffraction," 1993.

* cited by examiner

*Primary Examiner*—Stuart L. Hendrickson
(74) *Attorney, Agent, or Firm*—Oblon, Spivak, McClelland, Maier & Neustadt, P.C.

(57) ABSTRACT

Pitch based carbon fiber wherein the spread La of graphite crystallites constituting a fiber in the direction of layer plane is 1000 angstroms or less; the orientation angle Ψ in the direction of fiber axis is 10° or less, and the following relationship formulas (1) and (2) are satisfied:

$$0.70La-46\Psi>50 \quad (1)$$

$$0.55La-76\Psi<500 \quad (2).$$

6 Claims, No Drawings

PITCH BASED CARBON FIBERS

PITCH BASED CARBON FIBER

The present invention relates to a pitch based carbon fiber. In particular, it relates to a pitch based graphite fiber excellent in either a mechanical strength such as compression strength, tensile modulus and so on or thermal conductivity.

The pitch based graphite fiber of the present invention is suitably used as structural materials for space for which high dimensional stability and thermal shock resistance are required, and heat-dissipating materials for electronic devices.

High performance carbon fibers are generally classified into PAN-based carbon fibers prepared from polyacrylonitrile (PAN) as starting material and pitch based carbon fibers prepared from pitches as starting material, and they are widely used as e.g., materials for aircrafts, materials for sporting goods and materials for buildings, by taking advantages of their mechanical properties of high specific strength and high specific modulus of elasticity.

In addition to the above-mentioned properties, high thermal conductivity is required for the application to e.g., materials for space for which dimensional stability and thermal shock resistance under a large temperature difference are required, or heat-dissipating materials for electronic devices, and for such usage, carbon fibers to which a graphitization treatment is conducted are used. Many studies have been made to improve the thermal conductivity of the carbon fibers.

However, the thermal conductivity of commercially available PAN-based carbon fibers is less than 200 W/mK and insufficient. On the other hand, it has been generally considered that with pitch based graphite fibers, high thermal conductivity can readily be accomplished as compared with PAN-based carbon fibers.

However, the thermal conductivity of commercially available pitch based carbon fibers is usually less than 700 W/mK.

As a method for improvement, a method has been proposed in which graphite fibers having a high thermal conductivity which exceeds 1000 W/mK are produced by regulating the softening point of the pitch, the spinning temperature and the baking temperature (U.S. Pat. No. 5,266,295, European patent 481762 and JP-A-9-119024).

However, in such carbon fibers having a thermal conductivity of more than 1000 W/mK, the mechanical strength is generally insufficient. In considering the cause, the facts that the spread La of graphite crystallites constituting a graphite fiber is large and there are many fibers having cracks in their cross-sectional surface, may be affected. Further, the mechanical strength handling properties deteriorate, with a result that productivity decreases and physical properties decrease because of to partial breakage of fibers. Further, U.S. Pat. No. 5,721,308 proposes carbon fibers in which the thermal conductivity in a range of 500–1500 W/mK is specified. However, the thermal conductivities of the carbon fibers disclosed concretely in Examples are all less than 700 W/mK although the mechanical strengths are good.

As described above, it is difficult to say that carbon fibers having high thermal conductivity and mechanical properties with good balance has been reported realistically. Although carbon fibers having a thermal conductivity exceeding 1000 W/mK are partially commercialized, productivity is low and manufacturing cost is high. Further, since they do not have a sufficient mechanical strength independently, they are used at present for a heat radiation plate in combination with PAN-based carbon fibers having a thermal conductivity of less than 200 W/mK.

On the other hand, there has been an increased expectation of a heat-dissipating plate having higher emission properties(thermal conductivity property) with high densification of integration circuits. Under such circumstances, even though the thermal conductivity is in a range of about 700–1000 W/mK, they have a thermal conductivity of about twice that of copper which is a typical metallic material having high conductivity. If carbon fibers can be prepared which have such thermal conductivity and a sufficient mechanical strength, they can solely be processed in the form of heat-dissipating plates, and there is a remarkable development in this technical field. Accordingly, an object of the present invention is to provide a carbon fiber excellent in both mechanical strength and thermal conductivity.

The inventors of this application have made extensive studies about the structure of carbon fibers and the relationship of thermal conductivity and mechanical properties and so on, and have noticed in particular, the relation of the spread La of graphite crystallites constituting a fiber in the layer plane direction of the film to the orientation angle Ψ in the direction of fiber axis. As a result of the study on the conditions for producing a carbon fiber having characteristics in response to this, they have found a completely new carbon fiber which can sufficiently be distinguished in terms of physical properties from the conventional carbon fiber, and the present invention has been achieved.

Namely, the graphite fiber according to the present invention is a pitch based carbon fiber characterized in that the spread La of graphite crystallites constituting a fiber in the direction of layer plane is 1000 angstroms or less; the orientation angle Ψ in the direction of fiber axis is 10° or less, and the following relationship formulas (1) and (2) are satisfied:

$$0.70La-46\Psi>50 \quad (1)$$

$$0.55La-76\Psi<500 \quad (2).$$

In the following, the present invention will be described in further detail. In addition that the spread La of graphite crystallites constituting a fiber in the direction of layer plane and the orientation angle Ψ is the direction of fiber axis satisfy simultaneously the above-mentioned relationship formulas (1) and (2), they preferably satisfy simultaneously the below-mentioned formulas (3) and (4):

$$0.70La-46\Psi>120 \quad (3)$$

$$0.55La-76\Psi<350 \quad (4).$$

A carbon fiber deviating from the relationship formula (2) is poor in mechanical strength and is difficult to use although a higher value can be expected to a certain extent for the thermal conductivity. Further, a carbon fiber deviating from the relationship formula (1) can not have a high thermal conductivity of not less than 700 W/mK although the mechanical strength is good.

For the carbon fiber of the present invention, the spread La of graphite crystallites in the direction of layer plane is 1000 angstroms or less, preferably, 900 angstroms or less, and the orientation angle Ψ in the direction of fiber axis is 10° or less, preferably, 6° or less. The lower limit of the orientation angle Ψ is not particularly limited. However, it is realistically about 2°.

When La becomes large, the mechanical strength of the fiber is generally decreased. In one of main causes, a radial crack type fiber wherein when fibers are embedded in resin, and a cross-sectional surface of a fiber is polished and observed with a microscope, the cross-sectional surface of the fiber, which is originally circular is partly cut to show a sectorial shape, is apt to be produced. The carbon fiber is generally used in a shape of a tow of fibers wherein several hundreds to several thousands of fibers are gathered into one piece. The proportion of the number of radial crack type fibers in a tow of carbon fibers comprised of pitch based graphite fibers of the present invention is generally 20% or less, preferably, 10% of less. Further, the tow of graphite fibers is usually subjected to weaving to form a cloth or a process of impregnating resin to form a pre-preg. When the strength is low, a thread may be broken so that handling properties become poor. Accordingly, the proportion of the radial crack type fibers should be low for the purpose of increasing the strength of the tow of graphite fibers.

On the other hand, when La becomes smaller, the mechanical strength is generally increased, however, there is a problem that the thermal conductivity is decreased. In a great feature of the present invention, a carbon fiber having a high thermal conductivity has been found by reducing the orientation angle of a carbon fiber as possible. In the carbon fiber of the present invention, the laminated layer thickness Lc of graphite crystallites is generally 300–600 angstroms. Generally, both La and Lc are increased as the crystallites become large. Of the carbon fiber of the present invention however, since the orientation angle is maintained to be small while the crystallites are not made large, La/Lc is usually less than 1.5. Sufficiently guaranteed physical properties of the carbon fiber of the present invention are such that the tensile strength is 330 $kg/mm^2$ or more and the compression strength is usually 33 $kg/mm^2$ or more. Further, the thermal conductivity is generally 700–1000 W/mK.

According to studies by the inventors, the thermal conductivity of the carbon fiber depends on the size of graphite crystallites constituting a fiber and the orientation degree of the graphite crystallites in the direction of fiber axis. As these factors are larger, the thermal conductivity becomes higher. The reason why the thermal conductivity becomes higher when the graphite crystallites are larger can be considered as follows. When the graphite crystallites are large, the scattering of carriers for electricity and heat due to lattice defect becomes smaller with the result that the thermal conductivity becomes higher. However, when the graphite crystallites are excessively large, the strength of the fiber is decreased. Further, the degree of orientation of the graphite crystallites in the direction of fiber axis depends on the degree of orientation of a mesophase region in a pitch fiber obtained by spinning. And when the degree of orientation of the mesophase region is higher, the degree of orientation of the graphite crystallites in a carbon fiber is higher.

The carbon fiber of the preset invention as described above can generally be produced according to a known method for producing a pitch based carbon fiber. However, it is necessary to select conditions so that crystallites in a graphite fiber obtainable finally in each step of manufacturing is small and the degree of orientation in the direction of fiber axis of the graphite fiber is large. The carbonaceous material for preparing spinning pitch may be coal tar, coal tar pitch, a liquefied product of coal, petroleum-derived heavy oil, tar, pitch or a polymerization reaction product of naphthalene or anthracene obtained by a catalytic reaction. These carbonaceous materials contain impurities such as free carbon, insoluble coal, an ash component and a catalyst. It is advisable to preliminarily remove such impurities by a conventional method such as filtration, centrifugal separation or sedimentation separation by means of solvent. These carbonaceous materials are preferably used for the preparation of spinning pitch after a preliminary treatment has previously been conducted to adjust physical properties although they can be used for the preparation of spinning pitch as they are. The preliminary-treatment may be a method wherein after heating, a soluble content is extracted with solvent, a method for heating in the presence of a hydrogen donative solvent or a method of using hydrogen gas for hydrogenation.

The spinning pitch can be obtained by heat-treating the carbonaceous material at a temperature of usually 350–500° C., preferably 380–450° C. Although a time for heat-treatment is from several minutes to several ten hours, it is preferable to get desired physical properties for about 5 minutes–5 hours. Further, the heat treatment is preferably conducted in an atmosphere of an inert gas such as nitrogen, argon, hydrogen or the like, or while blowing such inert gas.

The spinning pitch obtained by the-heat treatment preferably has a high content of optically anisotropic structure, usually at least 70%, more preferably, at least 90%. The proportion of the optically anisotropic structure of pitch is a value obtained as a surface proportion, of the portion showing optical anisotropy in a pitch sample, as observed by a polarization microscope at room temperature. Usually, a pitch sample pulverized to a particle size of several mm square is embedded in substantially the entire surface of a resin with a diameter of 2 cm by a conventional method, and the surface is polished. Then, the entire surface is observed under a polarization microscope (100 magnifications), whereby the proportion of the area of the optically anisotropic portion in the entire surface of the sample is measured.

It is preferred to conduct spinning at a high temperature in a range of at least 40° C. but not less than 55° C. with respect to a softening point of pitch determined by a Metler method, in particular, at a high temperature in a range of at least 45° C. but not less than 50° C. so that the degree of orientation of a mesophase region in the obtained pitch fiber becomes high. Further, the degree of orientation of a mesophase region can be increased by increasing the fiber diameter of the pitch fiber. The fiber diameter of the pitch fiber is usually 10–20 $\mu$m. However, 13–18 $\mu$m is preferred. Pitch reaching a temperature for spinning is-extruded through a nozzle having, for example, an opening diameter of 0.1 mm, and is stretched to form a pitch fiber. Mesophase is oriented in the direction of fiber axis by stretching, and tends to orient in the direction of fiber axis until the pitch is solidified. Accordingly, if the spinning temperature is low or the fiber diameter is small, the pitch extruded through the nozzle opening is immediately solidified and a time of orienteering in the direction of fiber axis is short. Namely, the degree of orientation of the spinned pitch fibers in the direction of fiber axis is low. Further, when the fiber diameter is excessively large, pitch fibers having insufficient stretching are formed whereby the degree of orientation in the direction of fiber axis is low. The ordinary pitch fibers are formed by spinning pitch having a high temperature of not more than 40° C. from the Metler softening point wherein the fiber diameter is about 12.5 $\mu$m (9 $\mu$m in a stage of graphite fiber). However, in the present invention, pitch is spinned at a temperature at least 40° C. higher than the Metler softening point, and the diameter of pitch fibers is determined to be 15 $\mu$m (11 $\mu$m in a stage of graphite fiber)

which is 20% larger than the usual case. Accordingly, pitch fibers having a high degree of orientation in the direction of fiber axis can be obtained.

Further, when the tissue structure, i.e., domain of the carbon fiber becomes too large, the strength of the graphite fiber is decreased. Accordingly, it is important to prevent a pitch fiber having a large domain from being produced in spinning. As a method of making the domain of the pitch fiber smaller, a filler member is disposed in the spinning nozzle to disturb the flow of pitch. The filler member may be a filter of, for example, 40–2000 meshes, preferably, 100–1000 meshes. Further, beads made of a material such as metal or ceramic, glass or the like, or a metal powder used as a shearing-filtration material may be used.

The pitch fibers thus obtained are made infusible and carbonized in accordance with a conventional method. The infusibility treatment is conducted by heating a pitch fiber tow obtained by gathering the pitch fibers at a temperature of usually 300–380° C. in an oxidizing gas atmosphere. The carbonization is conducted by heating the obtained infusible fiber tow at usually 800° C. or more in an inert gas atmosphere of e.g., nitrogen or argon. Preferably, they are heated at such a temperature that the carbon content of the resulting carbon fibers is at least 97%, in particular, at least 99%. By the treatment, it is possible to minimize the dimensional change due to carbonization shrinkage of the carbon fibers in the subsequent treatment of graphitization and to prevent a decrease in the strength of the fibers due to a damage to the fibers.

The resulting carbon fiber tow is subjected to a surface treatment in accordance with a conventional method, and a sizing agent is applied. An amount of the application is usually 0.2–10 wt %, preferably, 0.5–7 wt %, to the fibers. The sizing agent may be a commonly used compound such as an epoxy compound, a water-soluble polyamide compound, a saturated or unsaturated polyester, polyvinyl acetate, polyvinyl alcohol, alone or a mixture thereof. These are usually used by dissolving with a suitable solvent such as water, alcohol, glycol or the like.

The carbon fiber tow is put into a crucible of graphite followed by heating in a calcination furnace to conduct a treatment of graphitization. Thus, the carbon fiber of the present invention is obtainable. It is preferred that the graphite crucible has a cover and high air-tightness so that an oxidizing gas in the calcination furnace does not enter into the crucible to react with the fibers. Further, it is preferable that when the finally resulted graphite fibers are used as cloth, they are processed to the cloth in a stage of the carbon fibers which are easily processed. The graphitization treatment is conducted usually at 2500–3500° C., preferably, 2800–3300° C., most preferably, 2900–3100° C. A time for the graphitization treatment is normally 1 hour or more at the above-mentioned temperature, preferably, 4 hours to 30 days. As the furnace used for the graphitization treatment, it is preferred to employ an Acheson resistance furnace excellent in productivity.

In the following, the present invention will be described in more detail by Examples. However, the present invention is not limited to these Examples as far as it is out of the subject.

The laminated layer thickness Lc of graphite crystallites and the spread La of graphite crystallites in the direction of the layer plane were obtained from the (002) diffraction and the (110) diffraction of graphite by "Method for Measuring the Lattice Constant and the Crystallite Size of Artificial Graphite" (Sugiro Otani et al. "Carbon Fibers", published by Kindai Henshusha (1986) p. 733–740) stipulated by the 117th committee meeting of Nippon Gakujutsu Shinkokai.

The orientation angle Ψ in the direction of fiber axis was obtained from the diffraction which was obtained by rotating a fiber sample table on which a graphite fiber tow was put so that the diffraction angle 2θ is fixed to the angle by which the (002) diffraction is obtainable, and the direction of fiber axis was directed to −90°–+90°.

To determine the thermal conductivity, a circular plate (diameter of 10 mm and thickness of 3–6 mm) of one directional carbon fiber reinforced plastic (CFRP) was prepared by graphite fibers and an epoxy resin, and the specific heat and the diffusivity of heat of the CFRP were measured by thermal constant measuring apparatus TC-3000 by laser flash method, manufactured by Shinku Riko K.K., whereupon the thermal conductivity was calculated by the following formula:

$$K=Cp\cdot\alpha\cdot\rho/Vf$$

where K is the thermal conductivity of the carbon fibers, Cp is the specific heat of CFRP, α is the diffusivity of heat of CFRP, ρ is the density of CFRP, and Vf is the volume fraction of graphite fibers contained in CFRP. The thickness of the circular plate was changed depending on the thermal conductivity of the fibers. A test sample with a high thermal conductivity was made thick, and the test sample with a low thermal conductivity was made thin. Specifically, it takes about several ten msec until the temperature of the rear side of the test sample increases to the maximum temperature after irradiation with a laser. In this case, the thickness of the circular plate was adjusted so that the time until the temperature rises to ½ of the temperature rising width ΔTm at that time, is at least 10 msec (the maximum: 15 msec). The specific heat was determined by bonding glassy carbon as a light receiving plate to the entire surface of the circular plate as a test sample and measuring the temperature rise after irradiation with a laser, by a R thermocouple attached to the center of the rear side of the test sample. The measured value was corrected by using sapphire as the standard sample. The diffusivity of heat was determined by forming a covering film on both surfaces of the test sample by a carbon spray until the surfaces became invisible and measuring the temperature change on the rear surface of the sample after irradiation of a laser, by an infrared ray detector.

The compression strength was measured in accordance with ASTM D3410. The measured value was a value obtained by converting the value into a volume fraction of 60% of the carbon fibers.

The strand tensile strength was the value obtained by measuring in accordance with JIS R 7601.

The proportion of radial crack type graphite fibers was obtained by embedding about 4000 fibers in resin, polishing the cross-sectional surface of fibers, observing the cross-sectional shape of fibers under a microscope (400 magnifications) wherein fibers having substantially circular in their cross-sectional shape are determined as non-radial crack type fibers.

EXAMPLE 1

Mesophase pitch having an optically isotropic structure of 100% in proportion as observed under a polarization microscope, and a softening point of 301° C. determined by a Metler method, was prepared from coal tar pitch. With use of four nozzles each having a discharge port of 0.1 mm in diameter, in the thinnest portion of which a filter of 500 meshes was disposed to provide a spinning head having 500 openings, the mesophase pitch was spinned at a spinning temperature of 349° C. at the discharge ports of the nozzles to obtain a tow of pitch fibers of a thread diameter of 15 μm and 2000 filaments.

The pitch fibers were made infusible, and were heated to the maximum temperature of 2500° C. in an inert gas atmosphere to be carbonized(pre-graphitization). Those had a carbon content of 99% or more. Then, a surface treatment was conducted, and 2% of an epoxy type sizing agent was added to obtain a carbon fiber tow. The strand tensile strength of the carbon fibers was 335 kg/mm$^2$.

The carbon fibers were wound on a bobbin of graphite, and it was put into a graphite crucible. Graphitization was conducted at 3000° C. in an Acheson resistance heating furnace. After a surface treatment was conducted, 2% of the epoxy type sizing agent was added to obtain a graphite fiber tow. Lc of the carbon fibers subjected to graphitization was 490 angstroms; La was 670 angstroms and Ψ was 5.10°. In the graphite fibers, the thread diameter was 11 μm; the strand tensile strength was 375 kg/mm$^2$; the compression strength was 35 kg/mm$^2$: the proportion of the radial crack type carbon fibers was 7%, and the thermal conductivity was high as 830 W/mK.

EXAMPLE 2

Graphite fibers were obtained in the same manner as in Example 1 except that mesophase pitch having a softening temperature of 302° C. determined by Metler method was used, spinning was conducted at a spinning temperature of 350° C. at the discharge openings of the nozzles, and the maximum temperature for pre-graphitization was 2240°. On the graphite fibers, the fiber diameter was 11.2 μm, the strand strength was 378 kg/mm$^2$, and the thermal conductivity was 810 W/mK. Lc of the graphite fibers was 570 angstroms. La was 750 angstroms, and Ψ was 5.1°, which satisfied the relationship formulas in claim 1.

EXAMPLE 3

Graphite fibers having a strand strength of 375 kg/mm$^2$ and a thermal conductivity of 780 W/mK were obtained in the same manner as in Example 1 except that the maximum temperature for the pre-graphitization was 2200° C. On the graphite fibers, Lc was 430 angstroms, La was 640 angstroms, and the Ψ was 4.5°, which satisfied the relationship formulas in claim 1.

COMPARATIVE EXAMPLE 1

A tow of pitch fibers of a thread diameter of 12.5 μm and 2000 filaments were obtained in the same manner as in Example 1 except that mesophase pitch having a softening point of 302° C. determined by Metler method was used and spinning was conducted at a spinning temperature of 340° C. at the discharge openings of the nozzles.

The pitch fibers were treated in the same manner as Example 1 to obtain a carbon fiber tow. On the carbon fibers, the strand tensile strength was 360 kg/mm$^2$.

Graphitization, a surface treatment and the application of a sizing agent were conducted to the carbon fibers in the same manner as Example 1 to obtain a carbon fiber tow. On the carbon fibers, the thread diameter was 9 μm, the strand tensile strength was 390 kg/mm$^2$, the compression strength was 49 kg/mm$^2$, and the proportion of the radial crack type carbon fibers was 3%. However, Lc was 320 angstroms, La was 510 angstroms, Ψ was 6.7° and 0.7La−46Ψ=48, which did not satisfy the condition specified in the present invention and the thermal conductivity remained to be 620 W/mK.

COMPARATIVE EXAMPLE 2

A tow of pitch fibers of a thread diameter of 12.5 μm and 2000 filaments was obtained in the same manner as Example 1 except that mesophase pitch having a softening point of 302° determined by Metler method was used; spinning heads were used (However, filters of 500 meshes disposed in the thinner portion of the nozzle openings were omitted), and the spinning temperature was 340° C.

The pitch fibers were made infusible in the same manner as in Example 1 and heated to the maximum temperature of 2670° C. in an inert gas atmosphere to conduct pre-graphitization. Then, treatments were conducted in the same manner as Example 1 to obtain a carbon fiber tow. In the carbon fibers, the strand tensile strength was 260 kg/mm$^2$.

Graphitization, a surface treatment and the application of an sizing agent were conducted to the carbon fibers in the same manner as Example 1 to obtain a graphite fiber tow. Although the thermal conductivity was high as 900 W/mK, the proportion of the radial crack type graphite fibers exceeds 95% and the strand tensile strength was low as 300 kg/mm$^2$. Lc was 940 angstroms, La was 940 angstroms, the orientation angle Ψ in the direction a fiber axis was 5.2° and the thread diameter of the carbon fibers was 10.8 μm.

The carbon fibers of the present invention have a high thermal conductivity and excellent mechanical properties such as strength, elasticity and so on. Carbon fibers can be presented to various type of use by forming them as a pre-preg in a form of a fiber tow or cloth in which a thermoset resin is impregnated, which is a material of high thermal conductivity, light weight and high strength. For example, it can be used suitably as a substrate for IC or a solar cell by taking an advantage of its having a high thermal conductivity, since temperature rise will result the breakage of the elements and reduction of efficiency. Further, it can also be used as a substrate for a solar cell in a space structure which requires all properties of light weight, high strength and high thermal conductivity.

What is claimed is:

1. A pitch based carbon fiber in which the spread La of graphite crystallites which constitute the fiber in the direction of the layer plane is 1000 angstroms or less, the orientation angle Ψ (in degrees) in the direction of the fiber axis is 10° or less, and the following relationships (3) and (4) are satisfied:

$$0.70La-46\Psi>120 \quad (3)$$

$$0.55La-76\Psi<350 \quad (4),$$

wherein, when a tow is formed by pitch based carbon fibers, the proportion of fibers having cracks in a cross-sectional surface of fibers is 20% or less, and wherein the tensile strength is 330 kg/mm$^2$ or more, and the compression strength is 33 kg/mm$^2$ or more.

2. The pitch based carbon fiber according to claim 1, wherein La is 900 angstroms or less, and Ψ is 6° or less.

3. The pitch based carbon fiber according to claim 1, wherein the laminated layer thickness Lc of graphite crystallites is 300–600 angstroms, and the La/Lc ratio is less than 1.5.

4. The pitch based carbon fiber according to claim 1, wherein the fiber is prepared by:

fusing optically isotropic pitch at a temperature of not less than 45 ° C. but not greater than 50° C. with respect to the Metler softening temperature of the pitch;

passing the fused pitch through nozzles thereby spinning the pitch into fibers having a diameter of 10–20 μm; and conducting infusibilization, carbonization and graphitization of the fibers.

5. The pitch based carbon fiber according to claim 1, wherein the spread La of the graphite crystallites which comprise the fiber in the direction of the layer plane is 900 angstroms or less, the orientation angle Ψ (in degrees) in the direction of the fiber axis is 6° or less.

6. The pitch based carbon fiber according to claim 1, wherein the thermal conductivity is 700–1000 W/mK.

* * * * *

UNITED STATES PATENT AND TRADEMARK OFFICE

CERTIFICATE OF CORRECTION

PATENT NO. : 6,303,096 B1
DATED : October 16, 2001
INVENTOR(S) : Yamamoto et al.

It is certified that error appears in the above-identified patent and that said Letters Patent is hereby corrected as shown below:

Title page,
Item [45], the Notice information should read:

-- [45] Date of Patent: *Oct. 16, 2001 --

-- [*] Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days. --

Signed and Sealed this

Eighteenth Day of June, 2002

*Attest:*

*Attesting Officer*

JAMES E. ROGAN
*Director of the United States Patent and Trademark Office*